US005173334A

United States Patent [19]

Lavaux

[11] Patent Number: 5,173,334

[45] Date of Patent: Dec. 22, 1992

[54] APPARATUS AND METHOD FOR IMPROVED HOT DIP METALLIC COATING OF METAL OBJECTS

[76] Inventor: Pierre Lavaux, 15, Rue de Prony, Paris, France, F-75017

[21] Appl. No.: 715,108

[22] Filed: Jun. 12, 1991

[51] Int. Cl.[5] ..... B05D 3/12

[52] U.S. Cl. ..... 427/241; 427/295; 427/377; 427/398.4; 427/432; 427/433

[58] Field of Search ..... 427/241, 377, 398.4, 427/432, 433, 295

[56] References Cited

U.S. PATENT DOCUMENTS

| | | | |
|---|---|---|---|
| 1,221,397 | 4/1917 | Watrous | 427/240 |
| 1,675,926 | 7/1928 | Dissel | 427/241 |
| 1,773,495 | 8/1930 | Newhall et al. | 427/240 |
| 3,429,295 | 2/1969 | Shapiro | 118/49.1 |
| 4,148,942 | 4/1979 | Gierek et al. | 427/241 |
| 4,196,231 | 4/1980 | Hubers | 427/240 |
| 4,210,095 | 7/1980 | Rouquie | 118/57 |
| 4,237,154 | 12/1980 | Garrison | 427/241 |
| 4,489,670 | 12/1984 | Mosser et al. | 118/55 |
| 4,526,127 | 7/1985 | Sippola | 118/54 |
| 4,633,804 | 1/1987 | Arii | 118/52 |

*Primary Examiner*—Janyce Bell

*Attorney, Agent, or Firm*—Joseph O'Keefe; Charles A. Wilkinson

[57] ABSTRACT

Apparatus and method for improving the metal coating on metal parts immersed in a molten metal coating bath of a different composition. The apparatus comprises (a) a vacuum pump, (b) a buffer tank, (c) centrifuge having a drum, a cover for sealing the drum, a platform within the drum to receive the parts and means to spin the platform, and (d) valved lines connecting with the drum cover and connecting, respectively, with the buffer tank a source of gas at atmospheric pressure and a source of gas at greater than atmospheric pressure. The tank has a volume of at least 10 times the volume of the drum.

The method comprises the steps of (1) transferring the molten metal coated metal parts from a molten metal coating bath to a centrifuge drum, (2) sealing the drum and creating a partial vacuum therein, (3) rapidly spinning the molten metal coated parts to permit excess molten coating metal to drain from the parts and cool the molten coating metal adhering thereto, (4) introducing a first gas at atmospheric pressure to the drum and spinning the parts at a reduced rate to permit the metal coating to cool below its liquidus temperature and solidify on the parts, and (5) introducing a second gas at a pressure greater than atmospheric pressure to the drum and further reducing the spinning thereof to permit the metal coating on the parts to further cool below 250° C.

29 Claims, 2 Drawing Sheets

APPARATUS AND METHOD FOR IMPROVED HOT DIP METALLIC COATING OF METAL OBJECTS

BACKGROUND OF THE INVENTION

The apparatus and method of the present invention are applicable to the production of parts, for example hardware such as nuts, bolts and other fasteners, which have been immersed in a bath of molten coating metal for applying a uniform coating of such metal to the surfaces of such parts.

Historically parts have been coated for decorative or protective purposes with a variety of metals, such as zinc and zinc alloys, aluminum and aluminum alloys, etc. The oldest and most common such coating metal is zinc, which has been in use for over 200 years for coating of large and small objects by a process known as hot-dip galvanizing. Generally, the application of a zinc coating to large objects presents fewer problems compared to those presented by the zinc coating of small objects. Such objects, such as fasteners, may have intricate shapes with crevices, holes or threaded portions within which the zinc coating builds up. Any such coating buildup creates problems from both an appearance and functional viewpoint.

In the prior art hot-dip galvanizing process, metal parts are placed into a basket which is immersed in a bath of molten zinc and then removed from the bath and spun in order to remove the excess zinc adhering to the parts. The smaller the part and the more intricate its shape the more difficult it is to remove the excess zinc coating. Defects apparent with the hot-dip galvanizing process are caused by too rapid cooling of the molten zinc due to the cooling resulting from the high velocity of air within the spinning chamber. The solidification of the molten zinc takes place rapidly before the excess zinc drains from the parts by centrifugal force and leads to non-uniform coating thickness. The fluidity of molten zinc on the surface of the fasteners is relatively small. The most common defects appear as too thin a coating on one side, i.e. front side, of the fasteners and solidified drops on the other side, i.e. back side. The latter defect is sometimes described as failure to spin-off the "last drop." In addition, the high velocity of the air during the spinning process also circulates small zinc particles within the spinning chamber. Coating metal remaining on the parts in the molten stage is subjected to impingement by the small particles of zinc, thus creating nucleations of zinc. Attempts have been made to promote uniform coating thickness and to reduce nucleation problems by sprinkling small amounts of fluxing chemicals on to the molten zinc to promote fluidity and to reduce oxidation. However, the boiling of the fluxing chemicals cools the meniscus of the excess zinc created at the touching points of parts resulting in the coated parts sticking together in clumps.

Several of the many patents directed to an invention which include a spinning or centrifuging step or spinning apparatus as part of a metallic coating process are as follows:

U.S. Pat. No. 1,773,495 to H. B. Newhall et al. utilizes a heated, non-oxidizing, neutral or reducing substance in a gaseous state circulated through a rotating screen positioned in a closed chamber and holding hot-dipped zinc coated parts.

U.S. Pat. No. 3,429,295 to Z. M. Shapiro is directed to a vapor deposition process for applying a coating on parts rolled in the vapor of the coating material on a rotating receptacle in a vacuum-tight chamber in a vacuum or inert atmosphere.

U.S. Pat. No. 1,418,942 to A. Gierek et al. is directed to a method of coating parts with a molten aluminum alloy by rotating a container holding the parts, within the range of 10–750 r.p.m., during its withdrawal from a bath of such alloy and then increasing the speed of rotation above the surface after withdrawal within the range of 10–1500 r.p.m.

U.S. Pat. No. 4,196,231 to E. Hubers describes apparatus and a method which includes vacuum impregnation of parts in a basket lowered into a tank of molten coating metal and subsequent spinning of the basket in air above the coating metal.

U.S. Pat. No. 4,526,231 to P. J. Sippola is directed to apparatus, i.e. a cage, for holding parts which are immersed in a zinc bath and then raised out of the bath into a centrifuging chamber having an oxygen-free atmosphere, such as nitrogen and rotated at a speed of 200–500 r.p.m.

Despite the claims made in the above mentioned patents about the quality achieved for the metallic coating applied to parts for decorative or protective purposes, the fact remains that presently available apparatus and methods for applying a metallic coating to metal parts for decorative or protective purposes do not produce a uniform coating and/or a coating without surface defects. The apparatus and method of this invention produces a metallic coated metal product with a uniform coating thickness and an improved surface condition.

GENERAL DESCRIPTION OF THE INVENTION

The apparatus of the present invention includes a basket, which holds molten metallic coated metal parts, adapted for placement on a centrifuge platform within a drum. The drum is sealed by a removable cover having valved lines that connect with sources of nitrogen and pressurized air and with a buffer tank, which is substantially larger than such drum, and which is connected to a vacuum pump.

The method of the present invention includes the following steps:

(Step I)—A basket of molten metal coated metal parts is removed from a coating bath and transferred to a centrifuge platform which is mounted within a drum, that is then sealed, and a partial vacuum created in the drum.

(Step II)—The platform and basket are spun rapidly to drain excess molten metal coating from the parts and slowly cool the molten metal coating adhering to them.

(Step III)—A first gas at atmospheric pressure is admitted to the drum and the spinning of the platform and basket continued at a slower speed to cause substantially uniform solidification of the metal coating on the parts.

(Step IV)—The supply of the first gas to the drum is cut off and a pressurized second gas admitted to the drum to quench the metallic coating while continuing spinning of the platform and basket at a further reduced rate and then stopped.

The basket of metal coated metal parts is removed from the drum and the parts are discharged in a convenient location.

DESCRIPTION OF THE DRAWINGS

The nature of the invention will be more clearly understood by reference to the following description, the appended claims, and the several views illustrated in the accompanying drawings.

DESCRIPTION OF THE PREFERRED EMBODIMENT

Figure 1:
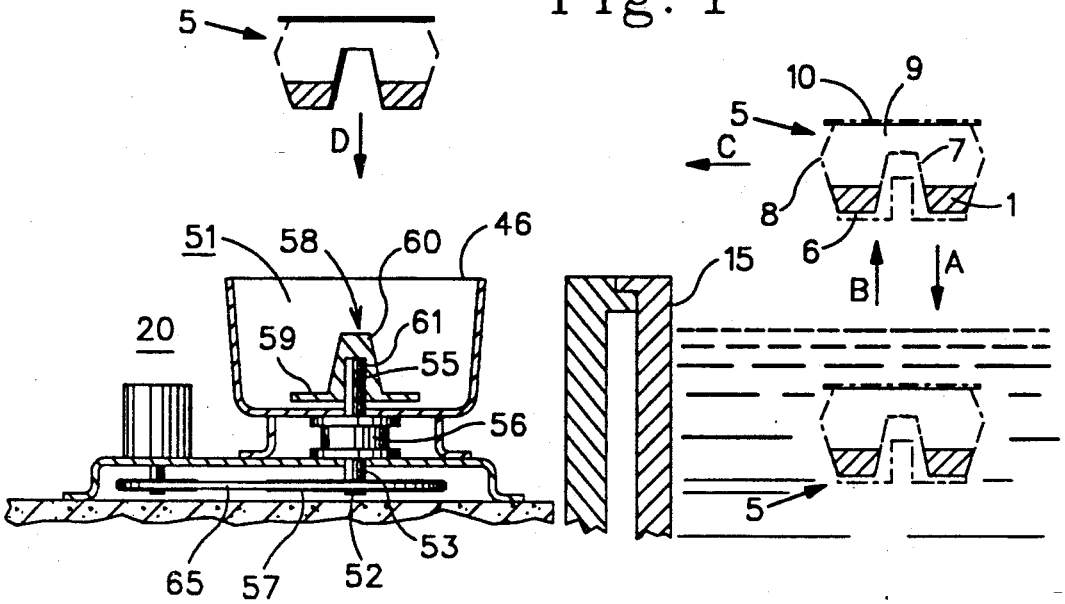
FIG. 1 is a schematic view, partly in section, illustrating several of the steps of the method of this invention and apparatus used in conjunction with such method.
Figure 2:
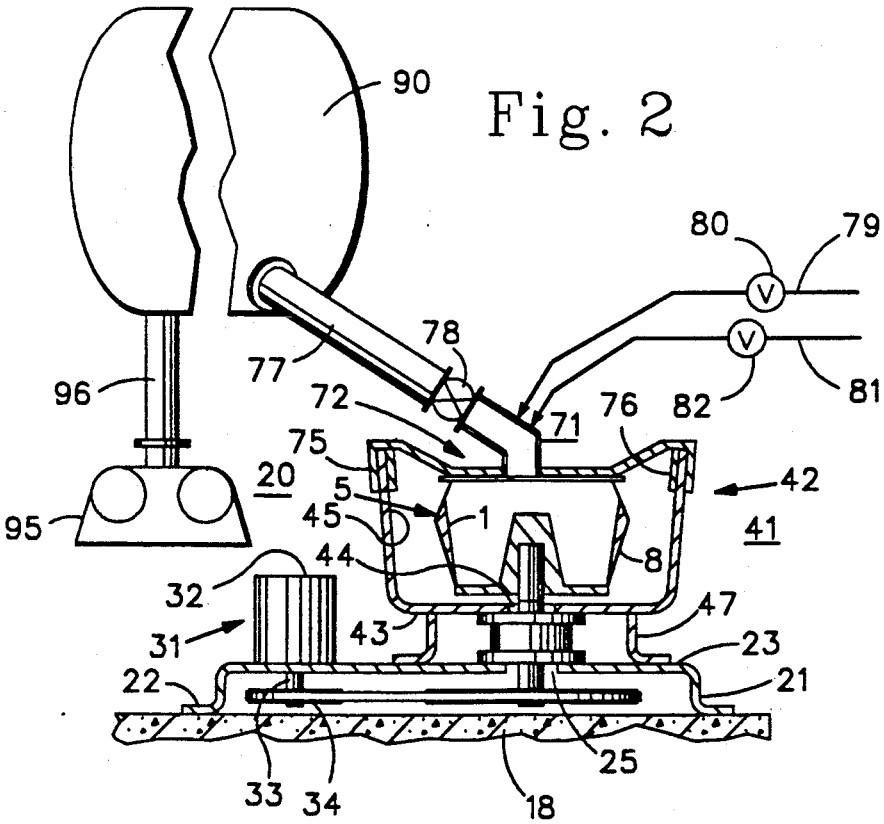
FIG. 2 is an enlarged schematic view, partly in section, of a portion of FIG. 1 illustrating further steps of the method of the invention and additional apparatus used in conjunction with such method.

Apparatus according to the invention is shown in FIGS. 1 and 2 and mainly comprises perforated basket 5 and centrifuge 20 having cover assembly 71. Perforated basket 5, which is of circular shape, has bottom 6 having indented central portion 7 in the form of a truncated cone, sides 8, open top 9 and cover 10. Sides 8 extend upwardly and outwardly from bottom 6 for about two thirds of the height of basket 5 and then are inclined inwardly to the top 9. Basket 5 is adapted to receive parts 1 in a variety of sizes and shapes, e.g. hardware in the form of nuts and bolts, to be immersed in a bath of molten metal 14 in melting pot 15.

Adjacent melting pot 15 is centrifuge 20 which comprises hollow base 21, drive assembly 31, drum assembly 41 and driven assembly 51. Base 21 has bottom flange portion 22, which is secured to foundation 18 in a manner known to those skilled in the art, as by bolting, and top 23 in which are holes 24 and 25, not identified in the Figures. Drive assembly 31 includes motor 32, motor shaft 33, which extends from the bottom of motor 32 downwardly through hole 24, not identified in the Figures, in base 21, and secured to the lower end of shaft 33 is drive pulley 34.

Positioned above base 21 is drum assembly 41 which includes circular drum 42 having bottom 43 with central hole 44, not identified in Figures, sides 45, open top 46 and pedestal 47 that extends downwardly from drum bottom 43 to base 21 to which it is fastened, as by welding.

Associated with drive assembly 31 and drum assembly 41 is driven assembly 51. Driven assembly 51 includes driven shaft 52, bearing 56, driven pulley 57, and platform 58. Driven shaft 52 extends vertically from the interior of base 21, through hole 25 in base top 23 and through hole 44 in drum bottom 43 into drum 42. Driven shaft 52 has lower portion 53, intermediate portion 54, not identified in the Figures, and upper portion 55. Mounted adjacent the lower end of shaft lower portion 53, within base 21, is driven pulley 57. Bearing 56 is mounted on the intermediate portion 54 of driven shaft 52, within drum pedestal 47, and is secured to the underside of drum bottom 43, as by bolts. Platform 58, which may be either a casting or weldment, has outer flat portion 59 and central portion 60 in the shape of a truncated cone of a slightly smaller size than basket bottom indented portion 7 of the same shape. Platform central portion 60 has blind hole 61 extending vertically upwardly from its bottom face and receives driven shaft upper portion 55. Drive belt 65 extends between motor shaft drive pulley 34 and driven pulley 57 mounted on the lower end of driven shaft 52.

As best shown in FIG. 2, cover assembly 71 includes cover 72, vacuum line 77, nitrogen line 79 and air line 81. Cover 72 has a central portion 73, outer flange 75 extending downwardly from the outer periphery of cover 72 and inner flange 76 spaced inwardly from outer flange 72 and extending downwardly from the underside of cover 72. Cover 72 fits snuggly over the upper end of drum 42 and the upper periphery of drum sides 45 fit with a sealing device, not shown, between drum outer flange 75 and inner flange 76 to seal drum 42. Vacuum line 77 connects with cover central portion 73 and extends through hole 74 therein, not identified, in the Figures, and is welded to cover central portion 73. Mounted in vacuum line 77 is valve 78 which connects with buffer tank 90 that connects with vacuum pump 95 by pump line 96. Preferably the volume of buffer tank 90 is at least ten times greater than the volume of drum 42. Nitrogen line 79 includes valve 80 and connects with a source of nitrogen, not shown, and air line 81 includes valve 82 and connects with a source of pressurized air, not shown.

The method of operation of the above described apparatus is as follows. After pretreatment in a manner well known to those skilled in the art, parts 1, which may be of ferrous metal, preferably steel, are deposited on bottom 6 of basket 5 that is moved in the direction of arrow A, as shown in FIG. 1, and immersed in molten metal coating bath 14 in heating pot 15. The molten metal coating bath 14, for example zinc which has a liquidus temperature of about 419° C., is maintained at a temperature of 40° C. or more above the liquidus temperature of the metal of the coating bath, which for zinc is about 459° C. The length of time parts 1 are immersed in the molten coating bath 14 depends on a number of variables, for example, the thickness of coating desired, the coating metal analysis, and the temperature of the coating metal.

After parts 1 have been immersed for a predetermined period Step I of the method of this invention begins. As shown in FIG. 1, basket 5 is raised from zinc coating bath 14 in the direction shown by arrow B and moved sideways in the direction shown by arrow C. Basket 5 is then moved downwardly in the direction shown by arrow D, and positioned on top of centrifuge driven assembly platform 58. Basket bottom indented portion 7 fits closely over and locks into platform central portion 60, both of which have the shape of a truncated cone, and basket bottom 6 rests on platform outer portion 59. Promptly after basket 5 has been placed on platform 58, cover assembly 71 is placed on drum 42 and sealed in a manner, well known to those skilled in the art, to make it gas tight. The period for transferring basket 5 from molten zinc coating bath 14 to platform 58 and the sealing of cover 72 on drum 42 is between about 3 to 5 seconds, preferably about four seconds. During this period the temperature of the molten zinc adhering to parts 1 will cool about 5° C., i.e. from about 459° C. to about 454° C.

Promptly after cover 72 has been sealed on drum 42, valve 78 in vacuum line 77 is opened. The air at atmospheric pressure in drum 42 instantly escapes into vacuum line 77 and buffer tank 90 creating an immediate partial vacuum in drum 42 in about 1 to 2 seconds, preferably 1 second. The creation of the immediate partial vacuum is a function of the degree of vacuum within buffer tank 90 and its volume, which is at least 10 times that of drum 42. Since the partial vacuum within buffer tank 42 is maintained at between 50% to 90%, i.e. about 0.5 to 0.1 atmosphere, by operation of vacuum pump 95, the partial vacuum subsequently created in drum 42 by the opening of valve 78 is only slightly lower than that which existed in buffer tank 92.

Step II begins promptly after a partial vacuum is achieved in drum 42, by starting motor 32 to place centrifuge 20 in operation. Motor shaft 33 turns pulley 34 which is connected by belt 65 to driven pulley 57 causing driven shaft 52 and platform 58 mounted thereon to rotate or spin rapidly at a speed of between about 200 to 800 r.p.m., preferably about 500 r.p.m. The rapid spinning of basket 5 on platform 58 causes parts 1, initially lying in basket bottom 6, as shown in FIG. 1, to shift to the basket's periphery against sides 8, as shown in FIG. 2, and causes excess molten zinc coating on parts 1 to drain from the parts, pass through the perforations of basket 5 and deposit on drum sides 45 and bottom 43. The rapid spinning of basket 5 is continued for between about 5 to 10 seconds, preferably about 5 seconds and then vacuum line valve 78 is closed. This period is longer than the minimum time, i.e. about 3 seconds, required for excess molten zinc to drain from the surfaces of parts 1 and to cool the metal coating adhering to such parts. Cooling occurs slowly at a rate of about 2° C. per second for total cooling of between about 10° C. to 15° C., i.e. to between about 444° C. to 439° C. for zinc, which is above the liquidus temperature of the zinc coating metal.

Step 11 begins with closing of vacuum line valve 78 and the opening of valve 80 in nitrogen line 79 to admit nitrogen, at atmospheric pressure, to pass through line 77 and into drum 42 to fill such drum and bathe the metal coated parts 1. Concurrently, the speed of motor 32 is reduced to slow the spinning of basket 5 to between about 150 to 250 r.p.m., preferably about 200 r.p.m., which takes place over a period of between about 3 to 5 seconds, preferably about 3 seconds. Nitrogen line valve 80 is then closed. The spinning of parts 1 in nitrogen permits the zinc coating metal on parts 1 to cool at a rate of about 20° C. per second to below the zinc liquidus temperature of 419° C. and solidify.

Step IV begins promptly after the closing of nitrogen line valve 80 with the opening of air line valve 82.

Pressurized air at between 2–6 atmospheres, i.e. between about 29 p.s.i. to 88 p.s.i., passes through line 81 into drum 42 to fill it with pressurized air. At the same time the speed of motor 32 is further reduced to slow rotation of platform 58 and basket 5 to between about 10 to 200 r.p.m., preferably about 80 r.p.m. The slower spinning is continued for a period of between about 10 seconds to 30 seconds, preferably about 20 seconds. The spinning of parts 1 in basket 5 on platform 58 in the pressurized air within drum 42 quenches, i.e. rapidly cools, the coated parts to below 250° C. and minimizes the circulation of zinc dust within drum 42. Thereafter, motor 32 is shut off, and the spinning of basket 5 stopped. Cover assembly 71 is removed from drum 42 and basket 5 lifted from such drum and moved to a convenient location, and the zinc coated parts 1 removed.

Figure 3:
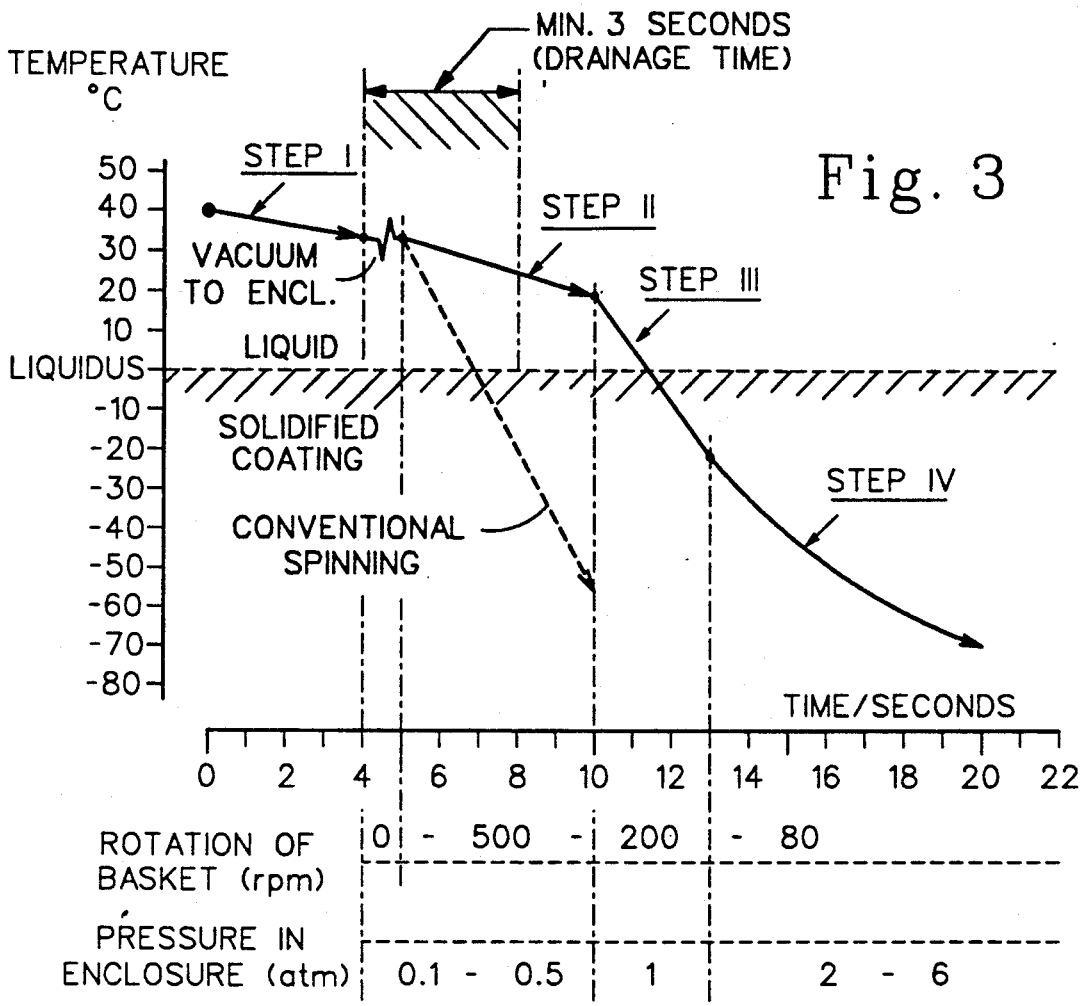
FIG. 3 is a chart illustrating a cooling curve showing the temperature changes that take place in a molten metal coating during the steps of the method of this invention as compared to the changes that take place in a metal coating during a conventional method of centrifuging molten metal coated metal parts at atmospheric pressure.

As shown in FIG. 3 wherein the temperature of the coating metal in degrees centigrade is indicated along the ordinate and the time in seconds for the steps of the method of this invention is indicated along the abscissa, the cooling that takes place is shown by the solid curve.

During Step I of the method, the temperature of zinc coating metal 1 decreases about 5° C. from about 459° C., which is at least 40° C. above the liquidus temperature of zinc, to about 454° C. or about 35° C. above the liquidus temperature for zinc.

During Step II, spinning of coated parts 1 at about 500 r.p.m. in a partial vacuum, i.e. about 50% to 90% vacuum, takes place for a period of between about 5 to 10 seconds, preferably about 5 seconds. The spinning of metal coated parts 1 in a partial vacuum provides sufficient time for all of the excess coating metal to drain from the surface of the parts without premature solidification while the adhering coating metal cools at a rate of about 2° C. per second. The total cooling that takes place is from about 10° C. to 15° C., which for the zinc coating represents cooling to between about 444° C. to 439° C.

During Step III spinning of the coated parts is continued, but at a reduced rate of between about 150 r.p.m. to 250 r.p.m., preferably about 200 r.p.m., in a nitrogen atmosphere at about atmospheric pressure. During this step which takes place for between about 3 to 5 seconds, preferably about 3 seconds, the zinc coating metal on the coated parts 1 cools at a rate of about 20 per second and solidifies below the zinc liquidus temperature of 419° C.

During Step IV the metal coated metal parts are bathed or quenched by pressurized air at a pressure of between about 2–6 atmospheres, preferably about 40 p.s.i. Spinning is continued, but at a further reduced rate of about 80 r.p.m., for between about 10 to 30 seconds, preferably about 20 seconds, which causes rapid cooling of the metal coating to below 250° C. for metallurgical purposes. Then the spinning is stopped, cover 72 removed from drum 42, and basket 5 is transferred to a convenient location and parts 1 discharged. For example, a bright zinc coating can be produced by gas-quenching of steel parts to a temperature below about 250° C. at the end of the spinning or centrifuge cycle to eliminate growth of FeZn layer at the center surface of the steel.

The benefits of the method of this invention are that coated parts, for example ferrous metal parts, e.g. steel, with crevices, holes and threads are clear of any build-up of excess metal. There is no prematurely solidified coating metal and the surfaces of the parts have a uniform coating thickness. This compares with prior art methods in which hot-dip molten metal coated parts are transferred from a coating bath to a centrifuge and spun at atmospheric pressure to remove any excess coating metal. The prior art spinning of molten metal coated parts causes the molten coating metal to cool rapidly below the liquidus temperature, as shown by the dotted line in FIG. 3, resulting in a build-up of metal in any crevices, holes and threads, solidification of an excess of metal, and a non-uniform thickness of coating on the parts. The cooling that takes place in the prior art spinning through the liquidus temperature is between about 50° C. to 100° C. at a rate of about 20° C. per second.

Figure 4:
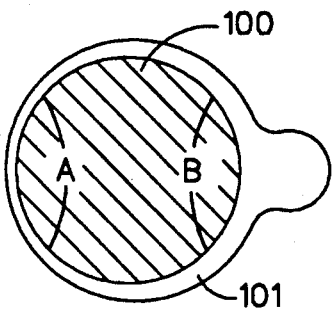
FIG. 4 is a cross-section of a fastener which was coated by a conventional practice and illustrates the non-uniform coating resulting from such practice.

FIG. 4 is a cross-section of fastener 100 which has front side A and backside B and which has a zinc coating 101 applied by a prior art coating method that included centrifuging at atmospheric pressure. Metal coating 101 is of non-uniform thickness, being too thin, i.e. about 40 μm, on front side A and too thick, i.e. about 50 μm on backside B where the common "last drop" remained. The thin coating on front side A results from high air pressure against such side, and the overly thick coating on backside B results from too rapid cooling, i.e. high viscosity of the molten metal on that portion of the surface.

Figure 5:
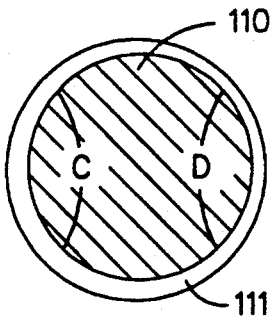
FIG. 5 is a cross-section of a fastener which was coated by the apparatus and method of this invention and illustrates the uniform coating resulting therefrom.

FIG. 5 is a cross-section of fastener 110 which has a front side C and backside D and which has a zinc coating 111 applied by the apparatus and method of this invention. Metal coating 111 is substantially uniform over the entire surface of fastener 110 and has a thickness of about 8–10 μm, an indication that there was no solidification of the coating before drainage was complete.

The term "non-uniform" as used herein with respect to coating thickness refers to a coated part wherein the thickness of coating on one portion of the part's surface is substantially thinner or heavier than the coating on another portion of such part's surface. The term "uniform" as used herein with respect to coating thickness refers to a coated part wherein the thickness of coating is substantially the same on all portions of the surface of such part.

The preferred embodiment of the invention described above is applicable to the coating of ferrous metal, i.e. steel, parts with a zinc coating. Steel parts may be coated by the same method with other metals, such as zinc alloys, aluminum, aluminum alloys, etc., recognizing that each coating metal has its own liquidus temperature. For example a coating metal of zinc+5% aluminum has a liquidus temperature of 381° C. Solidifying the molten metal coating in a nitrogen atmosphere improves the smoothness of the coating and contributes to its uniform thickness. Air may be used in Step III as a substitute for nitrogen but does not produce coated products of equal smoothness. Similarly in Step IV, steam at a temperature of about 100° C. may be substituted for pressurized air to rapidly cool the coated parts. In addition, parts made of other metals may be coated by the apparatus and method of this invention.

In the schematic views of the apparatus of this invention in FIGS. 1–3, the piping, i.e. vacuum line 77, nitrogen line 79, air line 81 and vacuum pump 96 are all shown connected by fixed lines to cover 72 and buffer tank 90, as appropriate, for illustrative purposes only. In similar fashion valves 78, 80 and 82 show no controls. The short time intervals required during the steps of the method of this invention require a rapid procedure for placing and sealing top 72 on drum 42 and rapid opening and closing of such valves. The apparatus required for each such procedure is known to those skilled in the art and does not form part of this invention.

It is recognized that modifications therein, variations of the above described apparatus and method can be made by those skilled in the art of the above, without departing from the spirit and scope thereof as defined in the appended claims.

I claim:

1. A method for improving the metal coating on metal parts immersed in a molten metal coating bath comprising the steps of:

(A) transferring the molten metal coated metal parts from the molten metal coating bath to a centrifuge drum;

(B) sealing the drum and evacuating air therefrom to create a partial vacuum therein;

(C) spinning the molten metal coated parts at a first rate within the partial vacuum of the centrifuge drum to permit excess molten coating metal to drain from the parts and to cool the molten coating metal adhering thereto;

(D) introducing a first gas from the group consisting of nitrogen and air to the centrifuge drum to bathe the molten metal coated parts therein and reducing the rate of spinning thereof to a second rate to permit the metal coating to cool below the liquidus temperature thereof and solidify on the parts;

(E) introducing a second gas from the group consisting of air and steam at a pressure greater than atmospheric pressure to the centrifuge drum to bathe the metal coated parts and further reducing the spinning thereof to a third rate to permit the metal coating on the coated parts to further cool, whereby the metal coating on the parts is of substantially uniform thickness.

2. The method of claim 1 wherein the partial vacuum created in the centrifuge drum is between about 0.5 to 0.1 atmospheres.

3. The method of claim 2 wherein the molten metal coated parts are spun at a first rate of from about 200 to 800 r.p.m. and the molten coating metal adhering to the parts is cooled to a temperature above the liquidus temperature of the coating metal.

4. The method of claim 3 wherein the molten metal coating adhering to the parts is cooled at a rate of about 2° C. per second in the range of between about 10° C. to 15° C.

5. The method of claim 4 wherein the molten metal coated parts are spun at a second rate of from about 150 to 250 r.p.m..

6. The method of claim 5 wherein the solidified metal coating adhering to the parts is further cooled at a rate of about 20° C. per second.

7. The method of claim 6 wherein the second gas is introduced to the centrifuge drum at a pressure of between about 2–6 atmospheres.

8. The method of claim 7 wherein the metal coated parts are spun at a third rate of from about 10 to 200 r.p.m..

9. The method of claim 8 wherein the metal coated parts are further cooled below a temperature of about 250° C..

10. The method of claim 1 wherein the metal parts are ferrous metal and the metal coating is zinc.

11. The method of claim 1 wherein the metal parts are ferrous material and the metal coating is a zinc alloy.

12. The method of claim 1 wherein the metal parts are ferrous material and the metal coating is aluminum.

13. The method of claim 1 wherein the metal parts are ferrous material and the metal coating is an aluminum alloy.

14. A method of improving the metal coating on metal parts immersed in a molten metal coating bath comprising the steps of:

(A) transferring the molten metal coated metal parts from the molten metal coating bath to a centrifuge drum within a period of between about 3 to 5 seconds;

(B) sealing the drum and evacuating air therefrom to create a partial vacuum therein in a period of between about 1 to 2 seconds;

(C) spinning the molten metal coated parts at a first rate for a period of about 5 to 10 seconds within the partial vacuum of the centrifuge drum to permit excess molten coating metal to drain from the parts and to cool the molten coating metal adhering thereto;

(D) introducing a first gas from the group consisting of nitrogen and air to the centrifuge drum to bathe the molten metal coated parts therein and reducing the rate of spinning thereof to a second rate for a period of between about 3 to 5 seconds to permit the metal coating to cool below the liquidus temperature thereof and solidify on the parts;

(E) introducing a second gas from the group consisting of air and steam at a pressure greater than atmospheric pressure to the centrifuge drum to bathe the metal coated parts and further reducing the spinning thereof to a third rate for a period of between about 10 to 30 seconds to permit the metal coating on the coated parts to further cool, whereby the metal coating on the parts is of substantially uniform thickness.

15. The method of claim 14 wherein the partial vacuum created in the centrifuge drum is between about 0.5 to 0.1 atmospheres.

16. The method of claim 15 wherein the molten metal coated parts are spun at a first rate of from about 200 to 800 r.p.m. and the molten coating metal adhering to the parts is cooled to a temperature above the liquidus temperature of the coating metal.

17. The method of claim 16 wherein the molten metal coating adhering to the parts is cooled at a rate of about 2° C. per second in the range of between about 10° C. to 15° C.

18. The method of claim 17 wherein the molten metal coated parts are spun at a second rate of from about 150 to 200 r.p.m..

19. The method of claim 18 wherein the solidified metal coating adhering to the parts is further cooled at a rate of about 20° C. per second.

20. The method of claim 19 wherein the second pressurized gas is introduced to the centrifuge drum at a pressure of between about 2–6 atmospheres.

21. The method of claim 20 wherein the metal coated are spun at a third rate of from about 10–200 r.p.m..

22. The method of claim 21 wherein the metal coated parts are further cooled below a temperature of about 250° C.

23. The method of claim 14 wherein the metal parts are ferrous metal and the metal coating is zinc.

24. The method of claim 14 wherein the metal parts are ferrous metal and the metal coating is a zinc alloy.

25. The method of claim 14 wherein the metal parts are ferrous metal and the metal coating is aluminum.

26. The method of claim 14 wherein the metal parts are ferrous metal and the metal coating is an aluminum alloy.

27. A method for improving the metal coating on metal parts immersed in a molten metal coating bath comprising the steps of:

(A) transferring the molten metal coated parts from the molten metal coating bath to a centrifuge drum;

(B) sealing the drum and evacuating air therefrom to create a partial vacuum therein;

(C) spinning the molten metal coated parts at a first rate within the partial vacuum of the centrifuge drum to permit excess molten coating metal to drain from the parts and to cool the molten coating metal adhering thereto;

(D) introducing nitrogen to the centrifuge drum to bathe the molten metal coated parts therein and reducing the rate of spinning thereof to a second rate to permit the metal coating to cool below the liquidus temperature thereof and solidify on the parts;

(E) introducing air at a pressure greater than atmospheric pressure to the centrifuge drum to bathe the metal coated parts and further reducing the spinning thereof to a third rate to permit the metal coating on the coated parts to further cool, whereby the metal coating on the parts is of substantially uniform thickness.

28. The method of claim 24 wherein the nitrogen is introduced at about atmospheric pressure on the centrifuge drum.

29. A method for improving the metal coating on metal parts immersed in a molten metal coating bath comprising the steps of:

(A) transferring the molten metal coated metal parts from the molten metal coating bath to a centrifuge drum within a period of between about 3 to 5 seconds;

(B) sealing the drum and evacuating air therefrom to create a partial vacuum therein in a period of between about 1 to 2 seconds;

(C) spinning the molten metal coated parts at a first rate for a period of about 5 to 10 seconds within the partial vacuum of the centrifuge drum to permit excess molten coating metal to drain from the parts and to cool the molten coating metal adhering thereto;

(D) introducing nitrogen at about atmospheric pressure to the centrifuge drum to bathe the molten metal coated parts therein and reducing the rate of spinning thereof to a second rate for a period of between about 3 to 5 seconds to permit the metal coating to cool below the liquidus temperature thereof and solidify on the parts;

(E) introducing air at a pressure greater than atmospheric pressure to the centrifuge drum to bathe the metal coated parts and further reducing the spinning thereof to a third rate for a period of between 10 to 30 seconds to permit the metal coating on the coated parts to further cool, whereby the metal coating on the parts is of substantially uniform thickness.

* * * * *

UNITED STATES PATENT AND TRADEMARK OFFICE

CERTIFICATE OF CORRECTION

PATENT NO. : 5,173,334

DATED : December 22, 1992

INVENTOR(S) : Pierre Lavaux

It is certified that error appears in the above-identified patent and that said Letters Patent is hereby corrected as shown below:

Col. 5, line 41, "Step 11" should read --Step III.

Col. 6, line 33, about 20 per second should read --about 20°--.

Col. 8, claim 11, line 56, "material" should read --metal--.
Col. 8, claim 12, line 58, "material" should read --metal--.
Col. 8, claim 13, line 60, "material" should read --metal--.
Col. 8, claim 14, line 62, "of" should read --for--.
Col. 8, claim 14, line 65, delete the word "the"--.
Col. 9, claim 21, lines 47-48, after "coated" insert the word --parts--.

Signed and Sealed this

Twenty-sixth Day of April, 1994

*Attest:*

Bruce Lehman

BRUCE LEHMAN

*Attesting Officer*

*Commissioner of Patents and Trademarks*